United States Patent [19]

Morimoto et al.

[11] Patent Number: 4,571,523

[45] Date of Patent: Feb. 18, 1986

[54] FLUORESCENT DISPLAY DEVICE

[75] Inventors: Kiyoshi Morimoto; Hiroshi Watanabe, both of Mobara, Japan

[73] Assignee: Futaba Denshi Kogyo K.K., Mobara, Japan

[21] Appl. No.: 536,645

[22] Filed: Sep. 28, 1983

[30] Foreign Application Priority Data

Oct. 23, 1982 [JP] Japan ..... 57-185384

[51] Int. Cl.[4] ..... H01J 63/06; H01J 19/40

[52] U.S. Cl. ..... 313/497; 313/496

[58] Field of Search ..... 313/496, 497, 510, 513, 313/517, 519

[56] References Cited

U.S. PATENT DOCUMENTS 3,418,509 12/1968 Frouws et al. ..... 313/519

3,509,402 4/1970 Du Bois et al. ..... 313/497

4,472,658 9/1984 Morimoto et al. ..... 313/497

*Primary Examiner*—George Yeung

*Attorney, Agent, or Firm*—Oblon, Fisher, Spivak, McClelland & Maier

[57] ABSTRACT

A fluorescent display device capable of eliminating a display defect, forming a display pattern with a sharp edge and providing excellent visibility. The fluorescent display device includes a conductive metallic film deposited on one surface of a transparent insulating substrate, frames each defined by the metallic film so as to have an inner periphery of a contour corresponding to a display segment corresponding thereto, and display segment openings each having an anode conductor formed with micro-gaps by partially removing the portion of the metallic film surrounded by the frame.

7 Claims, 9 Drawing Figures

FLUORESCENT DISPLAY DEVICE

BACKGROUND OF THE INVENTION

1. Field of the Invention

This invention relates to a fluorescent display device, and more particularly to a front emission-type fluorescent display device having an anode formed on one surface of a transparent substrate to allow the emission of a phosphor layer deposited on the anode to be observed through the other surface of the transparent substrate.

2. Description of the Prior Art

A front emission-type fluorescent display device is generally classified into two groups, one having an anode conductor formed of a transparent conductive film such as ITO(indium-tin-oxide) film, tin oxide film or the like and the other having an anode conductor formed of a metallic film.

The present invention is directed to a fluorescent display device of the latter type or the type that an anode conductor is formed by partially removing a metallic film deposited on a substrate by etching or the like and then being provided with transparency. A typical conventional fluorescent display device of such front emission-type is constructed in a manner to provide an anode on a transparent substrate which is formed of a metallic wire into a mesh-like shape corresponding to shape of a display segment to have light-permeable gaps, and deposit a phosphor layer on the anode, to thereby observe emission of the phosphor layer through the transparent substrate.

The conventional display device of this type is capable of significantly reducing voltage drop through a wiring, as compared with that having an anode formed of a transparent conductive film, because the wiring is formed by etching the metallic film.

However, in the conventional fluorescent display device of such type, an insulating material forming a transparent substrate or an insulating layer is exposed at the portion of the substrate which does not have a wiring conductor or a mesh-like anode formed thereon to cause electrons emitted from a cathode to be easily charged on the insulating material. When the charging of electrons occurs on the periphery of the mesh-like anode, electrons subsequently emitted from the cathode are deflected due to a negative electric field generated by the charged electrons to be obstructed from reaching the periphery of the mesh-like anode. This results in a display defect being caused on the periphery of the anode.

In order to obtain distinct and sharp luminous display, a phosphor layer should be deposited on a predetermined area of an anode conductor without any sagging. However, the prevention of such sagging in the conventional display device requires a troublesome indexing operation in a printing process and much time to adjust the viscosity of a phosphor layer in a process of depositing the phosphor layer.

A further disadvantage encounted with the conventional display device of such type is that the use of a printing procedure in the deposition of a phosphor layer on a mesh-like anode causes a phosphor paste to flow out from a predetermined area of the mesh-like anode to the peripheral area thereof due to sagging, so that a display pattern formed fails to have a sharp edge.

The present invention has been made in view of the foregoing disadvantages of the prior art.

Accordingly, it is an object of the present invention to provide a fluorescent display device which is capable of effectively preventing a display defect, allowing a display pattern to have a sharp edge and preventing components received in an envelope of the device from being observed through a substrate to provide excellent visibility.

In accordance with the present invention, there is provided a fluorescent display device comprising a transparent insulating substrate; transparent anode conductors arranged on one surface of the substrate according to a desired display pattern; a phosphor layer deposited on each of the anode conductors which is adapted to emit light when electrons emitted from a filamentary cathode impinge thereon, the light emission of the phosphor layer being observed from the other surface side of the transparent insulating substrate through the transparent anode conductor; a metallic film deposited on the one surface of the substrate; frames each having an inner periphery of a contour corresponding to a display segment corresponding thereto; and display segment openings each having the anode conductor contained therein, the anode conductor having micro-gaps formed therein by partially removing the portion of the metallic film surrounded by the frame; the phosphor layer being deposited to cover at least the display segment opening.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like parts therethrough, wherein.

DETAILED DESCRIPTION OF THE PREFERRED EMBODIMENTS

Now, a fluorescent display device according to the present invention will be hereinafter described with reference to the accompanying drawings.

Figure 1:
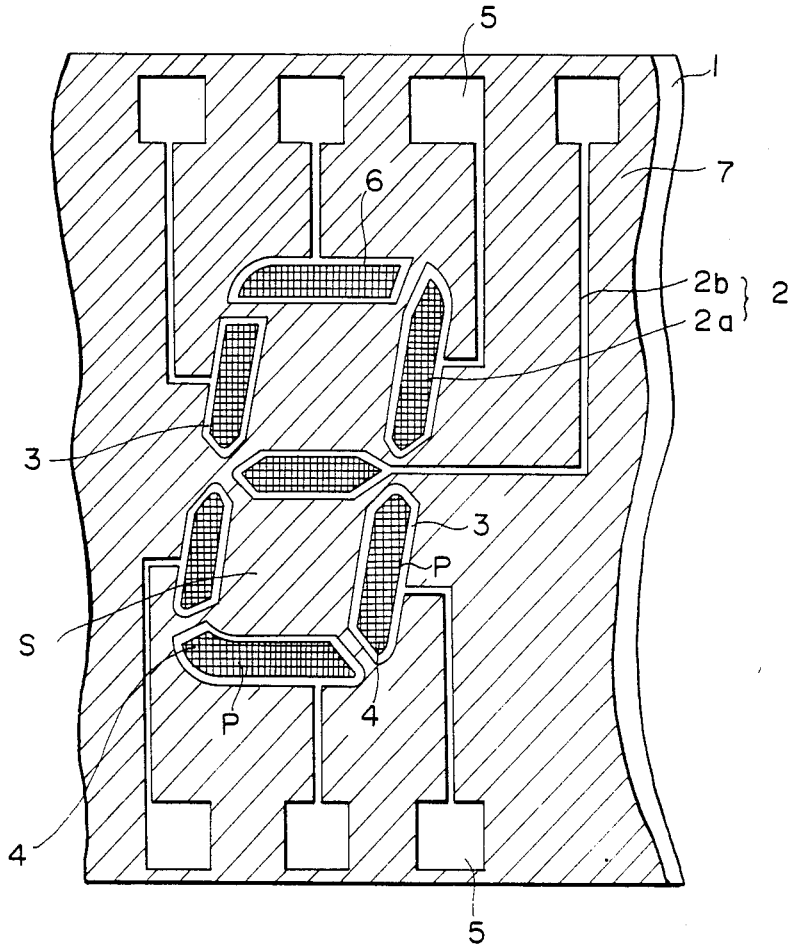
FIG. 1 is a schematic view showing the essential part of a first embodiment of a fluorescent display device according to the present invention.
Figure 2:
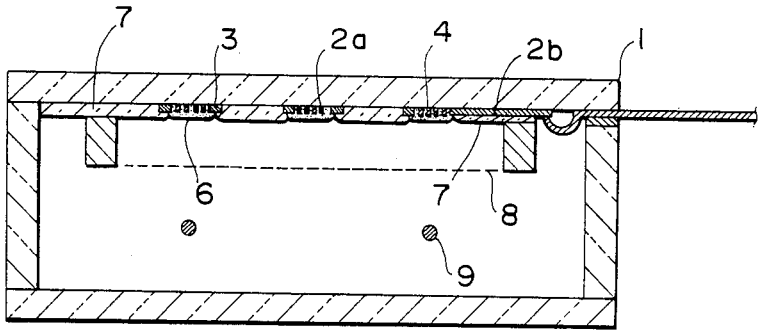
FIG. 2 is a sectional view of the fluorescent display device shown in FIG. 1.
Figure 3:
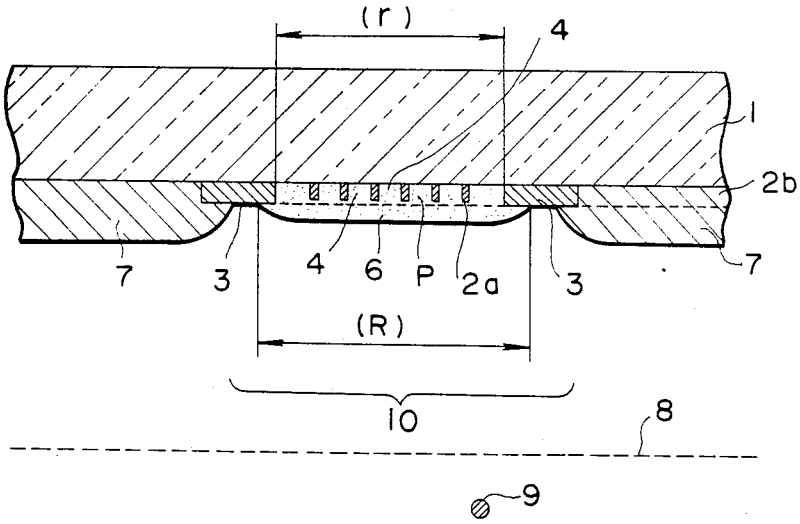
FIG. 3 is an enlarged sectional view showing the essential part of the fluorescent display device shown in FIG. 1.

Referring to FIGS. 1 to 3 illustrating a first embodiment of a fluorescent display device according to the present invention, the display device of the embodiment includes a transparent insulating substrate 1 made of, for example, sheet glass, or light scattering glass such as etched glass, ground glass or the like. The substrate 1 has a thin metallic film 2 of a conductive metal such as aluminum deposited on the inner surface thereof using any suitable physical procedure such as spattering, vacuum deposition or the like. The metallic film 2 is utilized at a part thereof as an anode conductor and a wiring conductor which will be described hereinafter.

More particularly, the unnecessary portion of the metallic film 2 deposited on the whole one surface of the substrate 1 is removed by photo-etching or the like to form a desired pattern display section S and wiring conductors.

First, a plurality of frames 3 are defined by the metallic film 2, each of which has an inner periphery of a contour corresponding to each display segment of the pattern display section S, and the portion of the metallic film 2 surrounded by each of the frames 3 is partially removed to form a display segment opening P having micro-gaps 4 formed therein.

Figure 5:
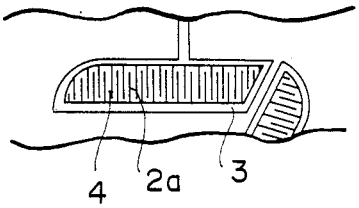
FIG. 5 is a schematic view showing another example of arrangement of an anode conductor.

The portion of the metallic film 2 within the display segment opening P is partially removed by etching to form the micro-gaps 4 and a microfine mesh-like anode conductor 2*a*. It is preferable to form the anode conductor 2*a* as finely as possible and form an interval between the adjacent gaps 4 as widely as possible in order to more effectively take out the emission of a phosphor layer. However, the interval between the gaps 4 is limited in view of the application of a uniform anode voltage to the phosphor layer. Thus, in the embodiment, the width of each wire of the anode conductor 2*a* and the interval between the gaps 4 are desirably set to be, for example, several to several tens μm and several tens to several hundreds μm, respectively. In the illustrated embodiment, the whole anode conductor 2*a* is formed into a shape of a rectangular mesh. However, it may be formed into a shape having a mesh of another polygon such as hexagon, octagon or the like or circle. Alternatively, the anode conductor 2*a* may be formed into a pectinate shape as shown in FIG. 5. Further, it may be arranged to form a stripe or ladder shape. The anode conductor 2*a* is electrically connected with the corresponding frame 3.

The metallic film 2 is further removed in part by etching to form a wiring conductor 2*b* of a fine metallic wire led out at one end thereof from the frame 3 of each display segment and formed at the other end thereof with a terminal connection 5.

Also, the portion of the substrate 1 other than that having the display segment openings P and the frames 3 formed thereon is applied thereon an insulating layer 7 which has the substantially same color as the non-luminous color of a phosphor layer 6 to prevent a control electrode 8 and a filamentary cathode 9 received in an envelope (not shown) of the device from being viewed from the outside.

The phosphor layer 6, as shown in FIG. 3, is deposited on the anode conductor 2*a* in a manner to contact with the frame 3 positioned around the periphery of the display segment opening P to cover at least the display segment opening P. More particularly, the phosphor layer 6, as shown in FIG. 3, is deposited to have a width R which is the substantially same as or somewhat larger than the width r of the display segment opening P. Deposition of the phosphor layer 6 may be carried out in a manner to form a gap between the peripheral edge of the phosphor layer 6 and the insulating layer 7. Alternatively, the phosphor layer 6 may be deposited to extend to the insulating layer 7. The so-deposited phosphor layer 6, anode conductor 2*a* having the gaps 4 formed therein and the frame 3 positioned at the periphery of the anode conductor 2*a* form an anode 10 together. The control electrode 8 and the filamentary cathode 9 are arranged opposite to the anode 10 formed on the substrate 1.

In the first embodiment constructed as described above, when electrons emitted from the filamentary cathode 9 and selected by the control electrode 8 impinge on the phosphor layers 6 deposited on the anodes 10 of a selected digit having an anode voltage applied thereto to allow the phosphor layers to emit light, the light passes through the phosphor layers 6, gaps 4 and transparent substrate 1 and is observed from the substrate side of the display device. The contour of a display pattern observed from the substrate side is defined by not the contour of the phosphor layer but that of the display segment opening P. Further, it should be noted that the contour of the display segment opening P is formed by subjecting the metallic film 2 to a photo-etching treatment, as described hereinbefore. Thus, the contour is clearly and sharply formed to allow the contour of an observed display pattern to be sharp.

Also, the outer periphery of the display segment opening P is provided with the frame defined by the metallic film 2. Therefore, even if the phosphor layer 6 sags at the outer peripheral portion thereof during deposition of the phosphor layer 6 on the display segment opening P, such sagging always occurs on the frame 3 positioned at the exterior of the display segment opening P; so that the sagging is effectively masked by the frame 3 of the metallic film 2 to be beyond a viewer's field of vision. This allows the phosphor layer 6 to carry out uniform light-emission only within the display segment opening P and allow the contour of the phosphor layer which is emitting light to be made more sharply by the display segment opening P. Further, even when the path of electrons which are to impinge on the anode 10 to emit light is disturbed by an electric field generated from the adjacent anodes 10 having a non-luminous voltage applied thereto to cause a display defect to be formed at the peripheral edge of the phosphor layer 6, such display defect is effectively masked by the frame 3 of the metallic film 2 to be beyond a viewer's sight of vision. Thus, it will be noted that the fluorescent display device of the present embodiment never causes any display defect which results in a display quantity being deteriorated.

In addition, the substrate 1 except the portion having the display segment openings P and the frames 3 formed thereon is covered with the insulating layer 7 having the same color as the non-luminous color of the phosphor layer 6 or a color such as black, gray or the like, so that the components such as the control electrode 8, filamentary cathode 9 and the like received in the envelope may be effectively hidden from the outside. Thus, it will be also noted that the fluorescent display device of the embodiment is capable of providing good visibility.

Further, when the substrate 1 is made of light scattering glass such as ground glass, etched glass, frosted glass, opal glass, non-glare glass or the like, the substrate 1 is faced at the satinized surface thereof with a viewer, to thereby effectively prevent halation due to surface reflection which is often encounted in the use of a substrate made of transparent glass.

Figure 4:
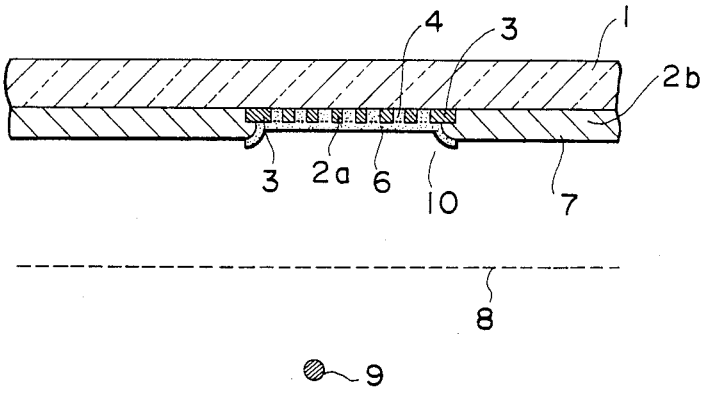
FIG. 4 is a sectional view showing another example of depositing a phosphor layer on an anode in the first embodiment.

Furthermore, in the fluorescent display device of the embodiment, as described hereinbefore, the frame 3 defined by the metallic film 2 is formed to be exposed at the outer periphery of the phosphor layer 6 as shown in FIG. 3 or the phosphor layer 6 of a simi-conductive property is deposited to extend to the portion of the insulating layer 7 positioned at the peripheral edge of the display segment opening P as shown in FIG. 4; accordingly, even when electrons emitted from the cathode 9 is charged on the insulating layer 7, charging of the electrons on the peripheral edge of the opening P is effectively prevented. Thus, the fluorescent display device of the embodiment is capable of substantially preventing a display defect due to the turbulence of an electric field, because charging causing such turbulence does not occur.

Still further, when the insulating layer 7 is formed of a material having the substantially same color as the non-luminous color of the phosphor layer 6, only the luminescence of the anode 10 or display segment opening P which is emitting light is observed and the anode 10 emitting light has a good contrast with respect to the background, thus, the fluorescent display device of the embodiment is capable of providing more excellent visibility.

Figure 6:
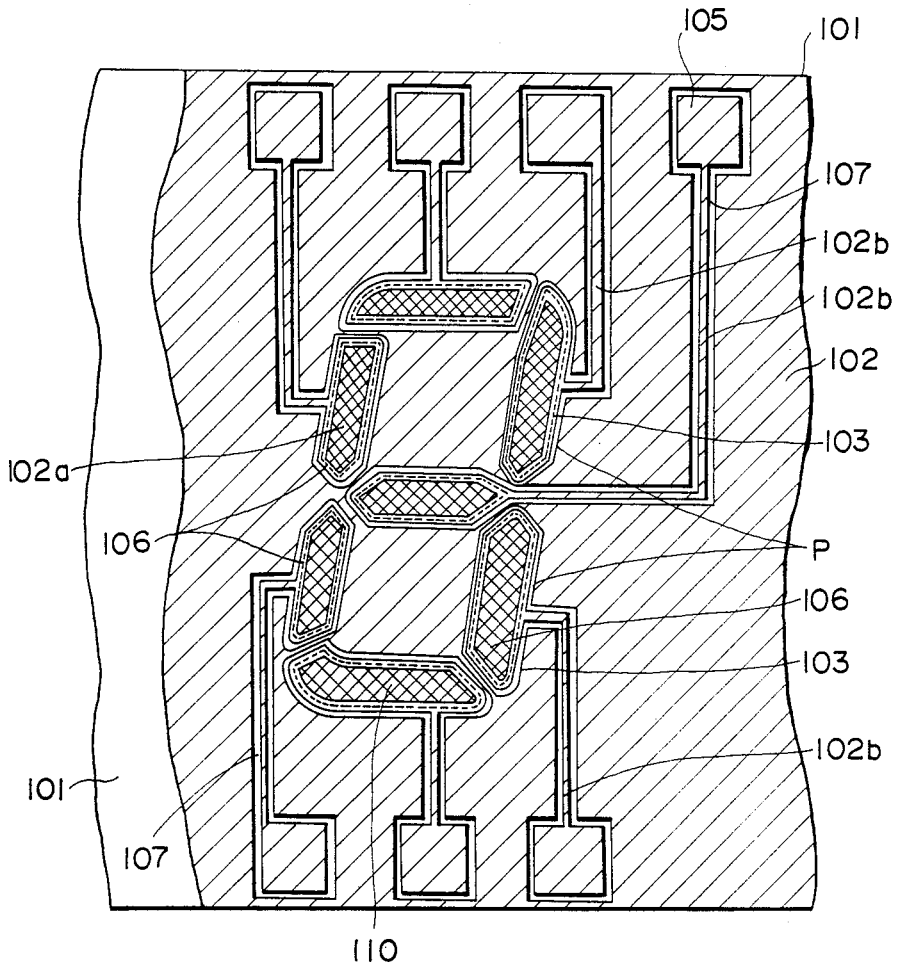
FIG. 6 is a schematic view showing the essential part of a second embodiment of a fluorescent display device according to the present invention.

Now, a second embodiment of a fluorescent display device according to the present invention will be described with reference to FIG. 6.

The second embodiment is adapted to be driven in a static driving system wherein a control electrode is eliminated and an auxiliary electrode is substituted therefor which is arranged on the same level as an anode to prevent charging of electrons on the periphery of the anode and accomplish uniform acceleration of electrons emitted from a cathode.

More particularly, first, a metallic film 102 deposited on a substrate 101 is subjected to a photo-etching treatment to form slits 107 to provide fine wiring conductors **102*b* and a terminal connection 105 at one end of each of the wiring conductors 102*b*. The wiring conductor 102*b* and terminal connection 105 are separated from the background metallic film 102 by the slit 107. Then, a frame 103 is formed joining with the corresponding wiring conductor 102*b* and subsequently an anode conductor 102*a* is formed in the frame 103 in the substantially same manner as the first embodiment. Further, a phosphor layer 106 is deposited on each of display segment openings P and the frame 103 positioned at the periphery of the opening P, as shown in dotted lines in FIG. 6. In the second embodiment as well as the first embodiment described above, the phosphor layer 106** is deposited to cover at least the display segment opening P.

The fluorescent display device of the second embodiment, as described above, is constructed to separate the background metallic film 102 from the anodes 102 and wiring conductors 105, thus, it is capable of effectively preventing a display defect by applying a potential constantly positive with respect to a cathode to always form a positive electric field around the anode.

Also, in the second embodiment, the formation of the substrate 101 of light scattering glass allows the metallic film 102 applied on the substantially entire surface of the substrate to exhibit not a specular gloss but a whity stain-like property due to light scattering by the substrate, thus, the background metallic film 102 has the substantially same color as the non-luminous color of the phosphor layer 106 to provide good visibility as in the first embodiment.

Figure 7:
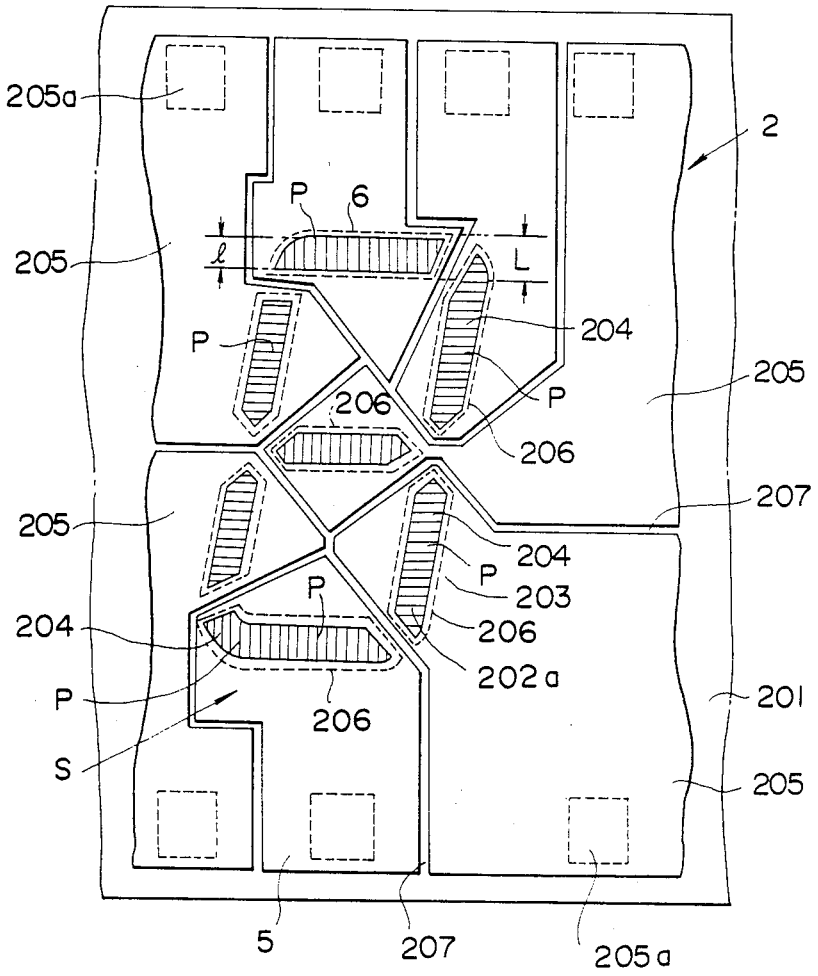
FIG. 7 is a schematic view showing the essential part of a third embodiment of a fluorescent display device according to the present invention.
Figure 8:
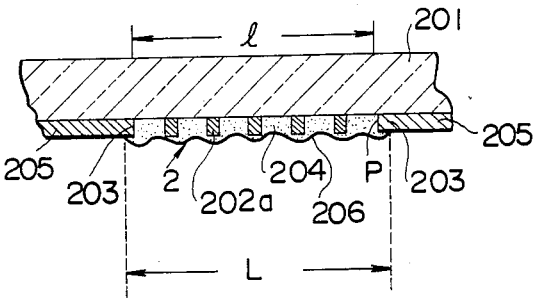
FIG. 8 is a partially enlarged sectional view of the fluorescent display device shown in FIG. 7.

FIGS. 7 and 8 illustrate a third embodiment of a fluorescent display tube according to the present invention.

The third embodiment is adapted to be used in a static driving system wherein a wiring conductor is formed of not a fine wire but a metallic film separated by a slit every segment and a part of the wire conductor acts as a frame formed at the outer periphery of an anode conductor.

In the fluorescent display device of the third embodiment, a metallic film deposited on one entire surface of a substrate 201 made of transparent sheet glass or light scattering glass is formed with slits 207 by photo-etching, to dividedly form wiring conductors 205 into a static driving pattern and provide one end of each wiring conductor 205 with a terminal connection **205*a* for connecting the wiring conductor 205 therethrough to an external terminal. The wiring conductor 205 is formed in the vicinity of the other end thereof with a display segment opening P. The display segment opening P is formed therein with a number of gaps 204 by photo-etching to provide an anode conductor 202*a* of a stripe-like shape. The outer periphery of the anode conductor 202*a* formed by the metallic layer defines a frame 203. A phosphor layer 206 is deposited to cover at least the display segment opening P. For example, in FIG. 7, the phosphor layer 206 is deposited on the area including the display segment opening P and the outer periphery thereof which is surrounded by dotted lines; and, in FIG. 8**, it is deposited on the area having a width L larger than a width l of the display segment opening P.

It will be readily understood that the third embodiment described above is driven in the substantially same manner as the first and second embodiments and has the substantially same advantages as those.

Figure 9:
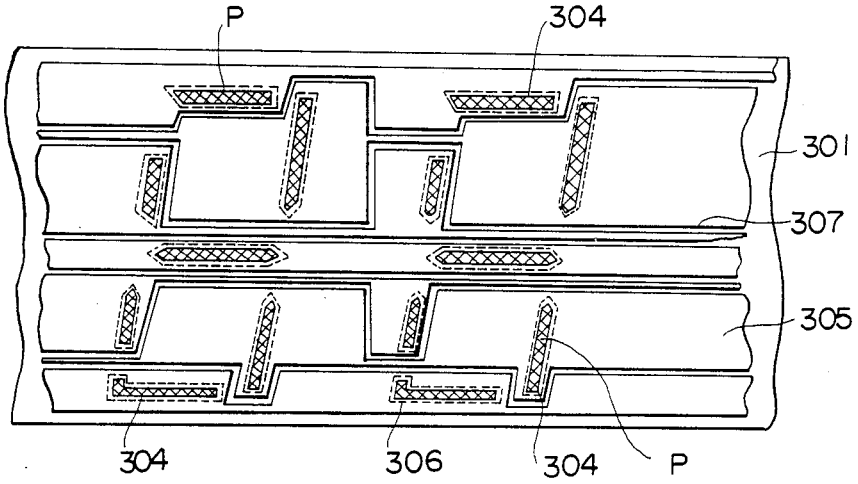
FIG. 9 is a schematic view showing the essential part of a fourth embodiment of a fluorescent display device according to the present invention.

FIG. 9 illustrates a fourth embodiment of a fluorescent display device according to the present invention, in which a wiring pattern is formed to act as a dynamic wiring pattern. Wiring conductors 303 are dividedly formed by subjecting a metallic film deposited on a substrate 301 to a photo-etching treatment to form slits 307 and each wiring conductor 305 is formed with an opening P for the corresponding segments of each digit. The display segment opening P is formed with a number of gaps 304 having a slit-like or mesh-like shape and has a phosphor layer deposited thereon to cover at least the display segment opening P. In FIG. 9, the phosphor layer is deposited on the area surrounded by dotted lines. The fourth embodiment corresponds to an example wherein the third embodiment has been applied to a wiring pattern of a dynamic driving system. It is of course that the first and second embodiments may be applied to such wiring pattern as well.

In the first to fourth embodiments described hereinbefore, the display pattern is formed into an 8-shaped pattern. However, the display pattern may be formed into any pattern of other suitable shape such as a figure pattern for a character display, a dotted pattern for an analogue display formed by arranging dot-like anodes in a matrix shape, a pattern for displaying various characters or marks, or the like.

As can be seen from the foregoing, the fluorescent display device according to the present invention is constructed in the manner of depositing the conductive metallic film on one surface of the transparent insulating substrate, partially removing the metallic film according to a desired display pattern to form the frames each having an inner periphery of a contour corresponding to the display segment and provide the display segment opening having the micro-gaps and the anode conductor of a fine wire formed in the frame, and depositing the phosphor layer on the display segment opening and its outer periphery to cover at least the display segment opening.

Thus, the present invention is capable of effectively preventing the charging of electrons on the periphery of the display segment opening and eliminating adverse effects due to the adjacent electrodes to prevent the generation of any display defect in the display segment opening, because the metallic frame or conductive phosphor layer is provided in the vicinity of the outer periphery of the display segment opening. Also, in the fluorescent display device of the present invention, the display segment opening has a contour sharply formed by the metallic film to allow the display pattern to carry out display having a sharp edge, resulting in the display quantity being significantly improved. Further, the portion of the substrate other than that having the display segment openings formed thereon is covered with the opaque colored insulating layer or the metallic film so as to allow the internal components to be beyond a viewer's sight of vision from the substrate side, to thereby provide excellent visibility.

Furthermore, the present invention does not require to carry out the deposition of a phosphor layer to precisely conform to the shape of the display segment opening, thus, the deposition of phosphor layer can be readily carried out, to thereby significantly improve workability.

As many apparently widely different embodiments of this invention may be made without departing from the spirit and scope thereof, it is to be understood that the invention is not limited to the specific embodiment thereof except as defined in the appended claims.

What is claimed is:

1. A fluorescent display device comprising:

a transparent insulating substrate;

transparent anode conductors having micro-gaps formed therein arranged on a first surface of said substrate according to a desired display pattern;

a filamentary cathode positioned apart from said transparent anode conductor for supplying electrons;

a metallic film deposited on said one surface of said substrate, said metallic film including wiring means and frames for defining display segment openings each having said anode conductor contained therein; and a phosphor layer deposited to cover at least said transparent anode conductors contained within and a portion of said frames, and which is adapted to emit light when electrons from said filamentary cathode impinge thereon with the light emission from said phosphor layer being observed from the second surface side of said transparent insulating substrate through said transparent anode conductor and to provide a uniform light emission through said display segment openings.

2. A fluorescent display device as in claim 1 wherein said metallic film further comprises:

an auxiliary electrode arranged on the same plane as said transparent anode conductors and maintained at a positive potential with respect to said filamentary cathode.

3. A fluorescent display device as in claim 1, wherein said micro-gap between said anode conductors is within a range of several tens to several hundred microns.

4. A fluorescent display device as in claim 1, wherein said anode conductor is several to several tens microns in wire diameter and is formed into a shape of a rectangular mesh.

5. A fluorescent display device as in claim 1, wherein said anode conductor is several to several tens microns in wire diameter and is formed into a pectinate shape.

6. A fluorescent display device as in claim 4 or 5, wherein said anode conductor is electrically connected to said frame.

7. A fluorescent display device comprising:

a transparent insulating substrate;

transparent anode conductors having micro-gaps formed therein arranged on a first surface of said substrate according to a desired display pattern;

a filamentary cathode positioned apart from said transparent anode conductor for supplying electrons:

a metallic film deposited on said one surface of said substrate, said metallic film including wiring means and frames for defining openings for corresponding segments of each digit and containing said anode conductors therein; and a phosphor layer deposited to cover at least said transparent anode conductors contained within and a portion of said frames, and which is adapted to emit light when electrons from said filamentary cathode impinge thereon with the light emission from said phosphor layer being observed from the second surface side of said transparent insulating substrate through said transparent anode conductor and to provide a uniform light emission through said openings.

* * * * *